US007828153B2

(12) United States Patent
Wattawa

(10) Patent No.: US 7,828,153 B2
(45) Date of Patent: Nov. 9, 2010

(54) MODULAR SYSTEM AND APPARATUS FOR PROCESSING RECYCLABLE MATERIALS, AND METHOD OF USING SAME

(76) Inventor: Kim T. Wattawa, P.O. Box 232, Howell, MI (US) 48844

( * ) Notice: Subject to any disclaimer, the term of this patent is extended or adjusted under 35 U.S.C. 154(b) by 597 days.

(21) Appl. No.: 11/893,717

(22) Filed: Aug. 17, 2007

(65) Prior Publication Data

US 2008/0078707 A1 Apr. 3, 2008

Related U.S. Application Data

(60) Provisional application No. 60/847,782, filed on Sep. 28, 2006.

(51) Int. Cl.
*B07C 7/04* (2006.01)

(52) U.S. Cl. ..... 209/630; 209/655; 209/703; 209/930

(58) Field of Classification Search ..... 209/702, 209/703, 706, 707, 930, 630, 655
See application file for complete search history.

(56) References Cited

U.S. PATENT DOCUMENTS 1,510,288 A * 9/1924 Clark ..... 193/34
4,002,229 A * 1/1977 Washington ..... 193/34
4,685,567 A * 8/1987 Webb ..... 206/506
4,987,988 A * 1/1991 Messina et al. ..... 193/2 R
5,015,122 A * 5/1991 Combes ..... 405/36
5,139,205 A * 8/1992 Gallagher et al. ..... 241/33
5,190,165 A * 3/1993 Garfield, Jr. ..... 209/655
5,271,507 A * 12/1993 Evans, Jr. ..... 209/657
5,366,097 A 11/1994 Hazelwood
5,425,458 A 6/1995 Gilcreest et al.
5,447,017 A 9/1995 Becher et al.
5,522,913 A * 6/1996 Peguy ..... 71/9
5,695,115 A * 12/1997 Shantzis et al. ..... 232/43.2
6,119,869 A 9/2000 Geiman
6,141,945 A 11/2000 Becher
6,296,132 B1 * 10/2001 Pickler ..... 220/1.5
6,443,057 B1 9/2002 Gazzoli
7,562,836 B2 * 7/2009 Langston ..... 241/23
7,581,629 B2 * 9/2009 Kohler ..... 193/25 A

FOREIGN PATENT DOCUMENTS

EP 1205404 A1 * 5/2002

* cited by examiner

*Primary Examiner*—Joseph C Rodriguez
(74) *Attorney, Agent, or Firm*—Carrier, Blackman & Associates P.C.; William D. Blackman; Joseph P. Carrier

(57) ABSTRACT

A system and apparatus for processing recyclable materials, including a header box, a plurality of routing channels connected to the header box, and a temporary storage container for each routing channel. During use, a user deposits one or more recyclable items into an intake header box, and the user then presses a selected button, corresponding to the material of the item, to control routing of the deposited item to a pre-sorted storage area. The header box includes a mirror, showing the routing channels, to allow a user to determine if the system is clear or blocked. The routing channels are made from modular units, so that the apparatus can be modified or adapted to meet the needs of different users, or the changing needs of a single user.

17 Claims, 10 Drawing Sheets

MODULAR SYSTEM AND APPARATUS FOR PROCESSING RECYCLABLE MATERIALS, AND METHOD OF USING SAME

BACKGROUND OF THE INVENTION

1. Field of the Invention

The present invention relates to a system and apparatus for processing recyclable materials. More particularly, the present invention relates to a system and apparatus for sorting and temporarily storing recyclable materials, in which the apparatus includes an intake header box and a plurality of routing channels connected to the header box. During use, a user deposits one or more recyclable items into the intake header box, and the user then presses a selected button to control routing of the deposited item to a pre-sorted storage area. Even more particularly, the present invention relates to a system and apparatus of the type described in which the routing channels are made from modular units, so that the apparatus can be modified or adapted to meet the needs of different users, or the changing needs of a single user.

2. Description of the Background Art

Recycling of certain materials such as, for example, glass, cans, and plastics, among other materials, is becoming more popular in today's increasingly environmentally-conscious society. Many communities now have facilities and equipment to pick up recyclable materials at curbside.

A number of different sorting and storage systems are known for processing recyclable materials. Examples of some of the known sorting and storage systems, for recycling used materials, include those described in U.S. Pat. No. 5,366,097 (Hazlewood), U.S. Pat. No. 5,425,458 (Gilcreest et al.), U.S. Pat. No. 5,447,017 (Becher et al.), U.S. Pat. No. 6,119,869 (Geiman), U.S. Pat. No. 6,141,945 (Becher), and U.S. Pat. No. 6,443,057 (Gazzoli).

Although the known sorting and storage systems have some utility for their intended purposes, a need still exists in the art for an improved modular sorting and storage system and apparatus for processing recyclable materials in the home or in a small business environment. In particular, there is a need for an improved recyclable material processing system which will overcome difficulties encountered with the known art.

SUMMARY OF THE INVENTION

The present invention provides an improved modular system, method and apparatus for processing recyclable materials. An apparatus according to the invention is usable to sort recyclable materials and to temporarily store recyclable materials in separate storage containers by material type, according to input from a user. In one embodiment, the apparatus includes an intake portion, which extends through an exterior building wall and into an interior room of the building, and a routing and storage portion which is disposed outside of the building.

In a first illustrative embodiment of the present invention, a modular apparatus for receiving and sorting recyclable materials is provided, including a hollow intake header box having an inlet door and defining a temporary holding area therein, and a plurality of routing ducts operatively attached to, and extending away from the intake header box. The routing ducts may use passive gravity feed as a mechanism for moving an item therethrough. The apparatus also includes a distribution mechanism operatively connected to the header box. The distribution mechanism is either disposed inside of the header box, or is situated between the header box and the plurality of routing ducts.

The apparatus for receiving and sorting recyclable materials according to the first illustrative embodiment also includes a plurality of selection buttons, either disposed on or operatively connected to the header box, for allowing a user to selectively indicate a material type corresponding to a recyclable item placed in the header box, and to control operation of the distribution mechanism for routing the item to the proper storage receptacle.

The apparatus according to the present invention may also include a plurality of storage receptacles, with a respective one of the storage receptacles disposed at a lower end of each of the routing ducts. Optionally, the storage receptacles may be made substantially sealable, in order to inhibit entry of insects, rodents, and other animals.

According to one embodiment of the present invention, a reflective mirror is mounted in the header box, in order to allow a user to view a reflected image therein of the sorting and distribution area of the system. The mirror enables the user to determine if there is any blockage or interference inside the system from inside a house without having to go outside of the house.

The apparatus for receiving and sorting recyclable materials according to the first illustrative embodiment is constructed using a plurality of interchangeable modular components, so that the apparatus can be adjustably adapted to different applications, depending on the needs of different users, or on the changing needs of a single user.

Many of the interchangeable modular components are made with a hinge-like structure, including a plate portion having a substantially straight peripheral edge, and a plurality of regularly spaced-apart cylindrical tube sections attached to the peripheral edge of the plate portion. Each of the tube sections has a longitudinal axis which is disposed substantially parallel to the peripheral edge to which it is attached. The spaced-apart cylindrical tube sections are adapted to cooperatively intermesh with the spaced-apart cylindrical tube sections of another adjacent modular component, at which point the adjacent modular sections can be interconnected as described below.

When the tube sections of adjacent modular components are intermeshed and aligned with one another, the adjacent components can be connected in one of two ways. The first way of connecting the intermeshed tube sections is to slidably place a rod inside of the aligned tube sections, and the second, alternate way of connecting the intermeshed tube sections is to place an outer, external tube which has a longitudinal portion thereof removed, so that it has a C-shaped cross-section, over and partially covering a substantial exterior portion of the aligned tube sections.

Selected components of the interchangeable modular components may include substantially rectangular plate portions. Other selected components of the interchangeable modular components may include substantially triangular plate portions, or other polygonal plate portions having flat edges.

Optionally, some or all of the plate portions of the interchangeable modular sections may be formed from a translucent or transparent plastic material.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

It should be understood that only structures considered necessary for clarifying the present invention are described herein. Other conventional structures, and those of ancillary and auxiliary components of the system, are assumed to be known and understood by those skilled in the related art.

The present invention provides an improved modular system, method and apparatus for processing recyclable materials. An apparatus according to the invention is usable to sort and separate recyclable materials according to input from a user, and to temporarily store the sorted recyclable materials in separate storage containers by material type.

Figure 1:
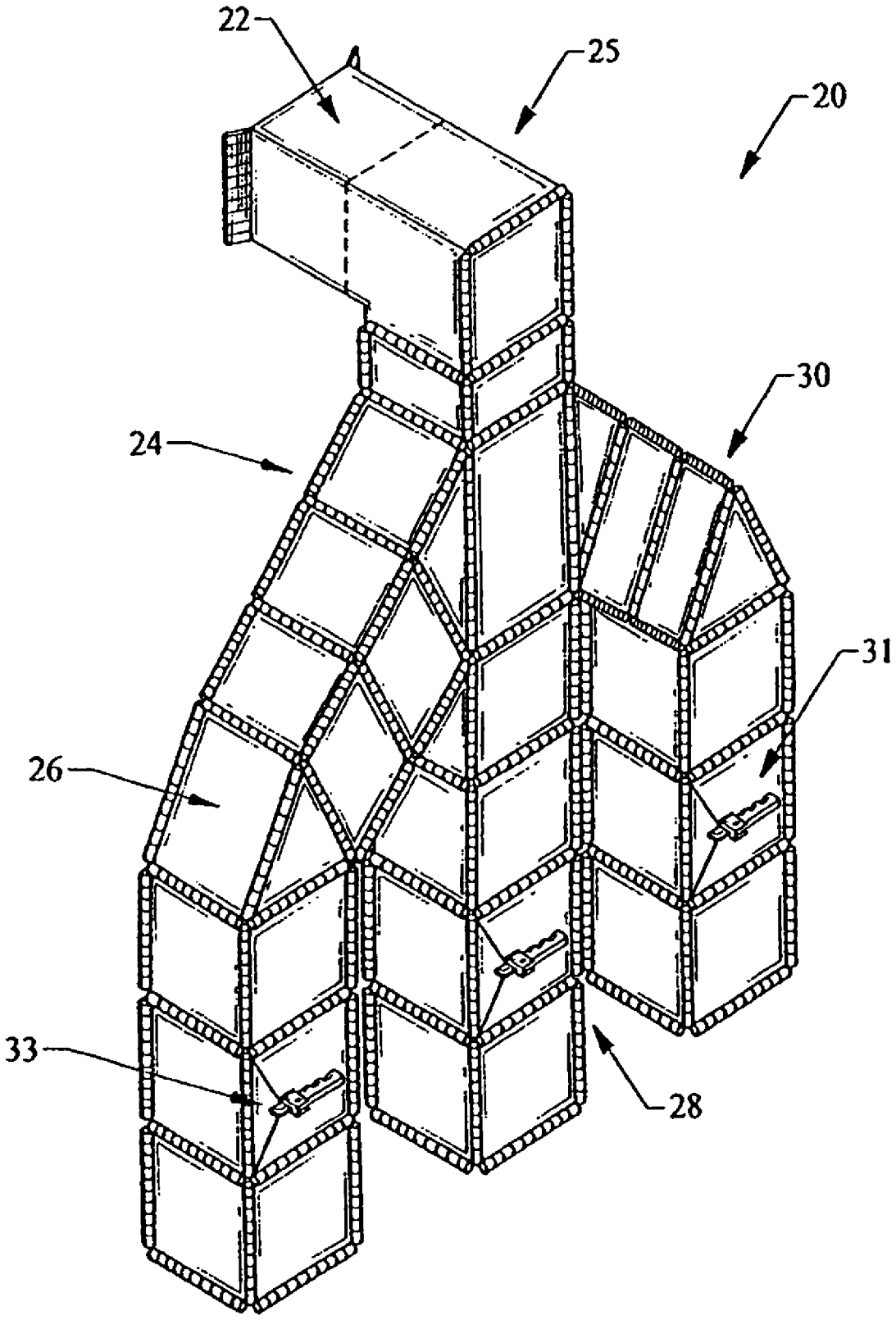
FIG. 1 is a perspective view of an apparatus for receiving and sorting recyclable materials according to a first illustrative embodiment of the present invention.
Figure 2:
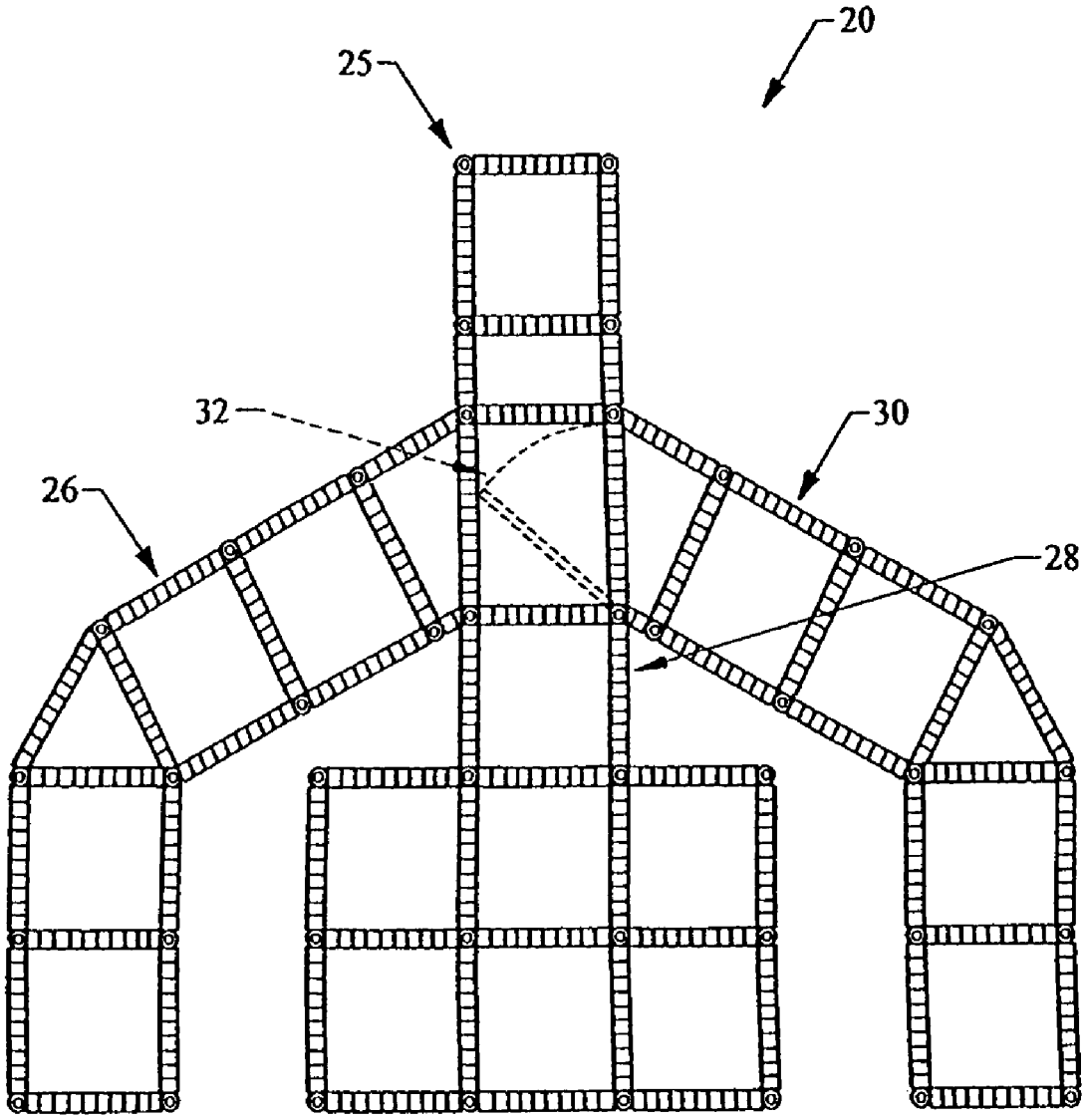
FIG. 2 is a rear plan view of the apparatus of FIG. 1, modified to have an enlarged storage area at a central portion thereof.
Figure 3:
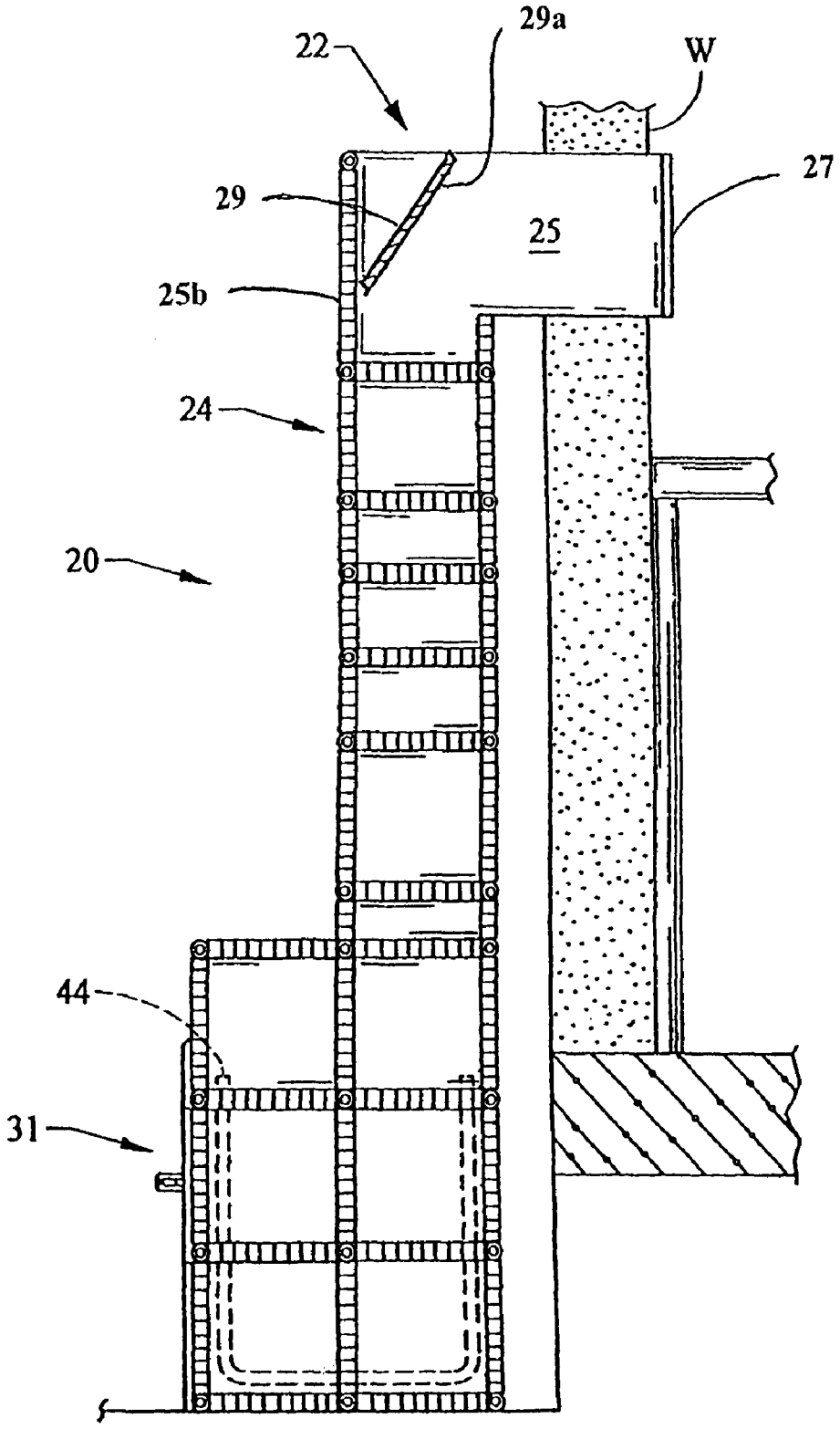
FIG. 3 is a side elevational view of the apparatus of FIGS. 1-2, also showing a wall of a building through which part of the apparatus extends.

Referring now to FIGS. 1-3 of the drawings, a first illustrative embodiment of an apparatus for processing recyclable materials is shown generally at 20. In the embodiment of FIGS. 1-3, the apparatus 20 includes an intake portion 22, part of which is adapted to extend through a building wall W (FIG. 3) and into an interior room of a building, such as a single family home, small business, or similar application. The apparatus 20 also includes a routing and storage portion 24 which is adapted to be disposed outside of the building.

In an alternative application of the apparatus 20, it could be free standing and not associated with a building or other structure. Due to the modular nature of the components making up the apparatus 20, it may be made large or small, wide or narrow, short or tall, etc, to conform to the environment in which it is used. In addition, after installation in a setting, it may easily be modified, as needed, to fit changing requirements of a user.

In the embodiment of FIGS. 1-3, the apparatus 20 is usable for receiving, sorting and temporarily storing recyclable materials, such as glass (sorted by color), plastic of different grades, metal cans, etc. The apparatus 20 includes a hollow intake header box 25, having an inlet door 27 and defining a temporary holding area therein, and a plurality of routing ducts 26, 28, and 30, operatively attached to, and extending away from the intake header box 25. Within header box 25 is a mirror 29 pivotally mounted by a hinge 14 to the rear wall 25*b* of the header box 25 and adjustably supported by a chain 15 attached to the rear wall 25*b* of the header box 25. The mirror 29 has a reflective surface 29*a* such that reflective surface 29*a* provides a user with a reflected view of the routing ducts 26, 28, and 30 and distribution mechanism 32, from inside the house upon which the system 20 is mounted, without having to go outside to view the entire system 20.

The routing ducts 26, 28, and 30 may use passive gravity feed as a mechanism for moving an item therethrough. Each of the routing ducts 26, 28, 30 may have a door 31 formed in a lower section thereof to provide access to a storage receptacle 44 (FIG. 3) disposed therein, and this door 31 may be provided with a unique handle and latch mechanism 33, as discussed further below. The storage receptacles 44 are disposed above ground level, as shown in FIG. 3.

The storage receptacles 44 may be formed in different sizes, if desired, to accommodate expected storage needs for different materials. As an example of this, FIG. 2 illustrates that a central routing duct 28 may be made larger at the bottom end thereof than adjacent routing ducts 26, 30 if it is anticipated that there will be a need for a larger storage receptacle 44 therein. This is just one example of how the modular nature of the apparatus 20 allows it to be made adaptable to accommodate the needs of different users, or the changing needs of a single user.

Figure 10:
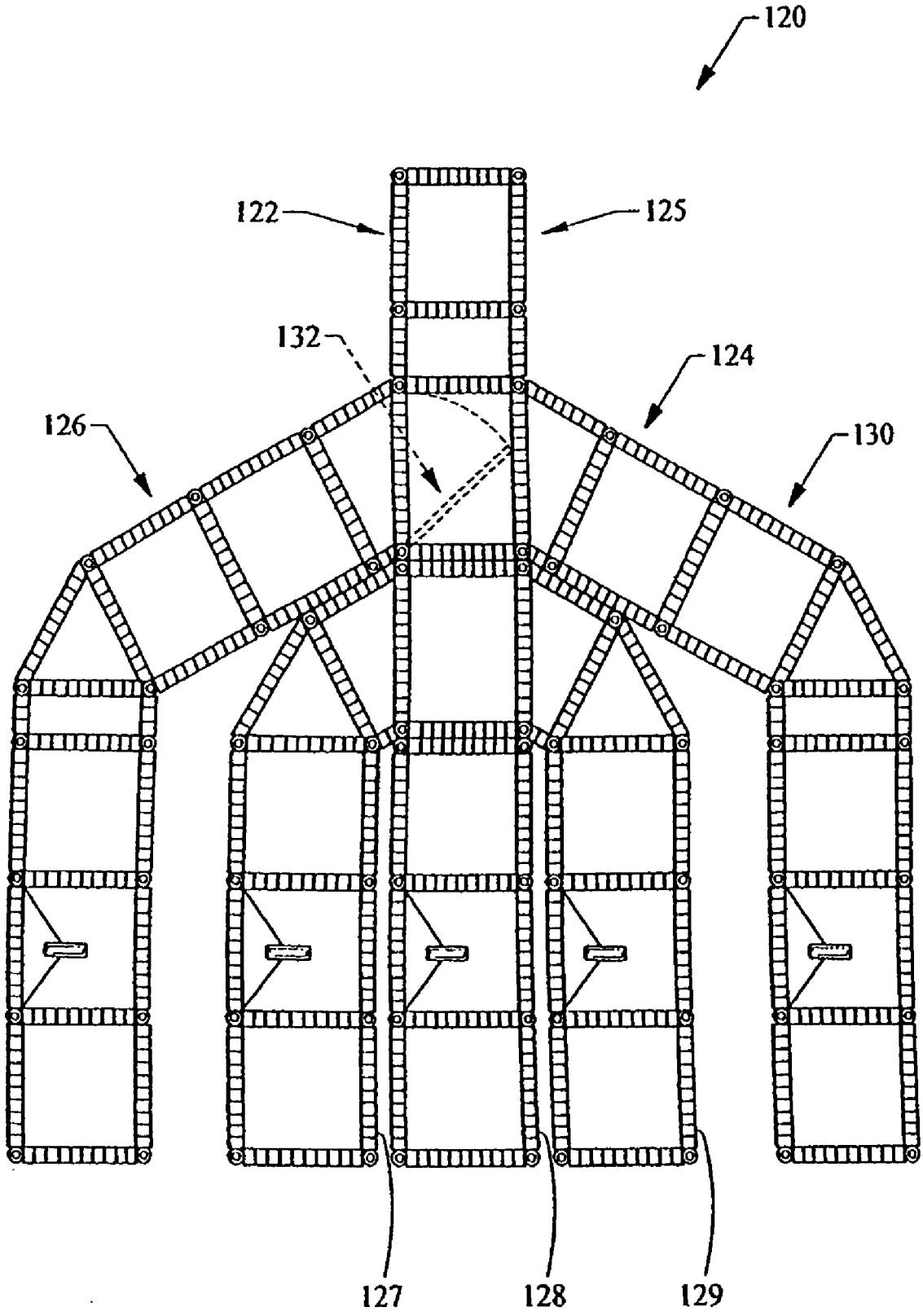
FIG. 10 is a rear plan view of an apparatus for receiving and sorting recyclable materials according to a second illustrative embodiment of the present invention.

The apparatus 20 for receiving and sorting recyclable materials according to the first illustrative embodiment also includes a distribution mechanism 32 operatively connected to the header box 25. The distribution mechanism 32 may be disposed inside of the header box, or alternatively, the distribution mechanism 32 may be situated between the header box and the plurality of routing ducts. The distribution mechanism 32 may include mechanical and/or electromechanical components, and includes at least one movable routing gate. Optionally, the distribution mechanism 32 may include a first selectively operable routing gate situated proximate a first side wall of the header box as shown in FIG. 2, and a second selectively operable routing gate situated proximate a second side wall of the header box, as shown in FIG. 10. In addition, if desired, the distribution mechanism 32 may include an optical scanner for reading a code on a recyclable item, to indicate the type of material in the header box 25.

Figure 9A:
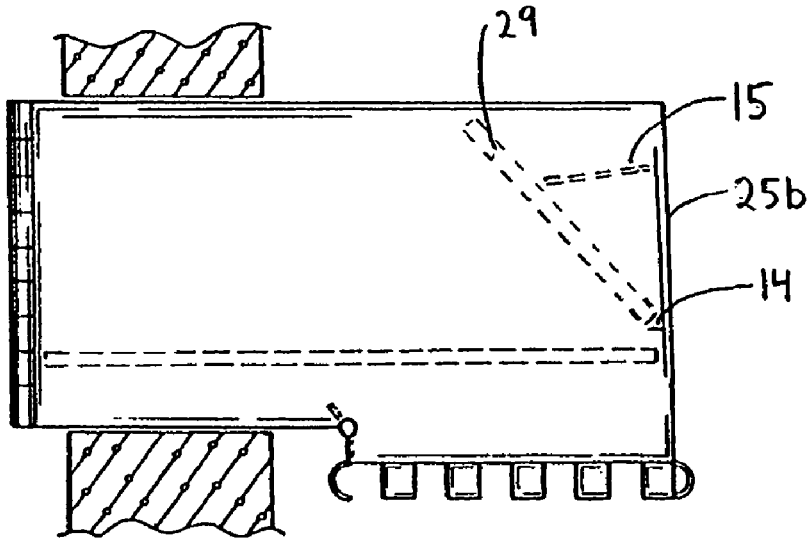
FIG. 9A is a side plan detail view of an intake header, including an angled mirror, which is another component of the apparatus of FIGS. 1-3.
Figure 9B:
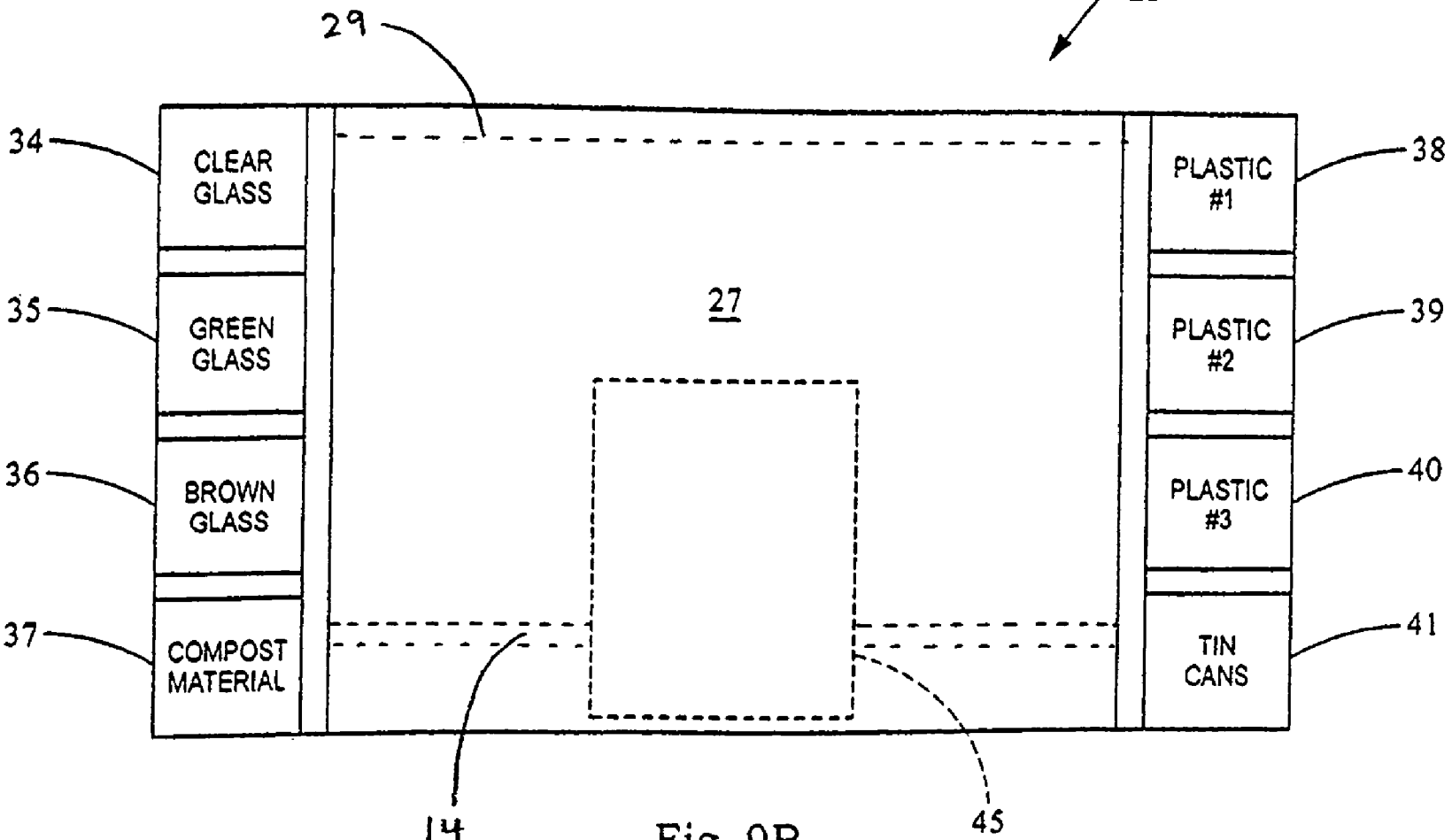
FIG. 9B is a front plan detail view of the intake header box of FIG. 9A.

As seen best in FIG. 9B, the apparatus 20 for receiving and sorting recyclable materials according to the first illustrative embodiment also includes a plurality of selection buttons such as those shown at 34-41, operatively connected to the header box 25, for allowing a user to selectively indicate a material type corresponding to a recyclable item 45 placed in the header box, and thereby to control operation of the distribution mechanism 32 for routing the item to the proper storage receptacle 44. The mirror 29 with reflective surface 29*a* provides a user with a reflected view of the routing ducts 26, 28 and 30 allowing a user to view any obstruction within the routing ducts 26, 28 and 30 and the distribution mechanism 32.

The apparatus according to the present invention may also include a plurality of storage receptacles 44, with a respective one of the storage receptacles disposed at a lower end of each of the routing ducts 26, 28, 30. Optionally, the storage receptacles 44 may be made substantially sealable, in order to exclude insects, rodents, and other animals.

Figure 4A:
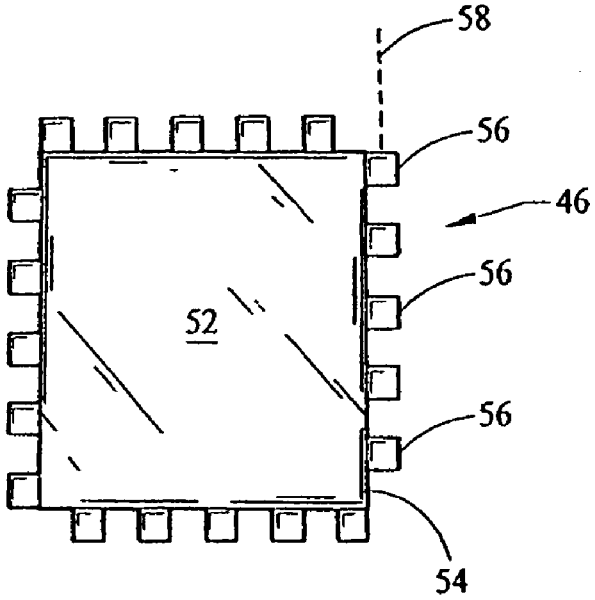
FIG. 4A is a top plan view of a rectangular modular unit which is a component of the apparatus of FIGS. 1-3.
Figure 4B:
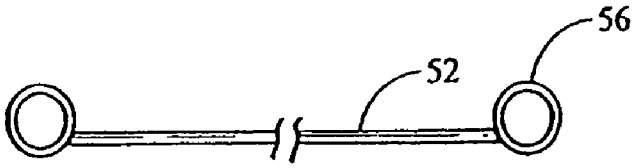
FIG. 4B is a side plan view of the rectangular modular unit of FIG. 4A.
Figure 4C:
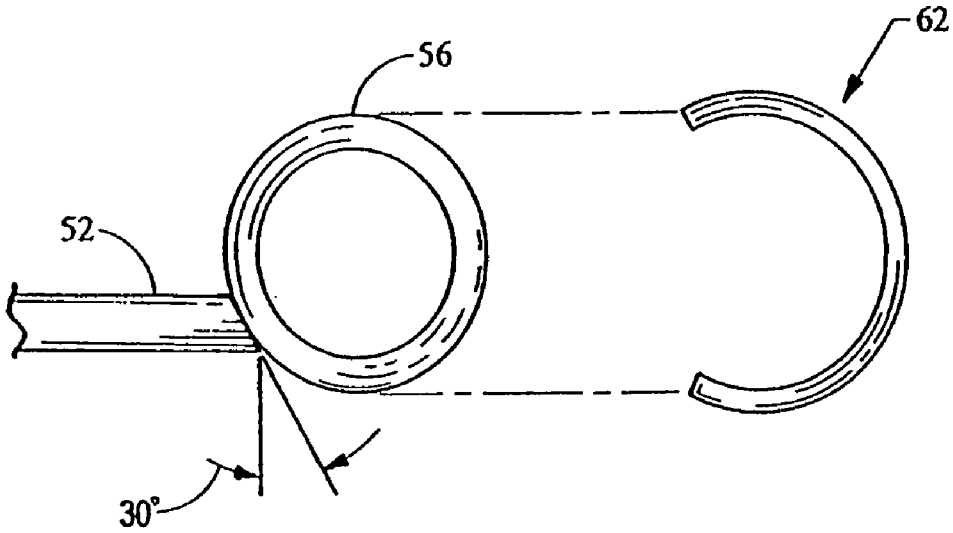
FIG. 4C is an enlarged detail view of an edge portion of the rectangular modular unit of FIG. 4B.
Figure 7:
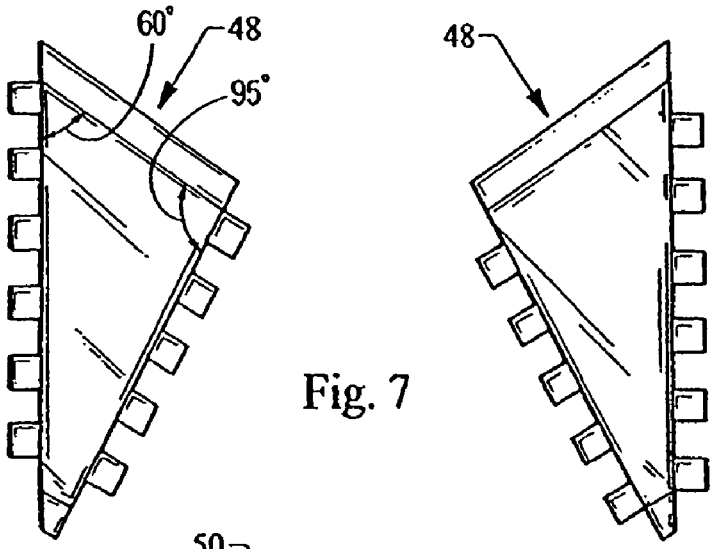
FIG. 7 is a top plan view of two right triangular modular sections which are also components of the apparatus of FIGS. 1-3.
Figure 8:
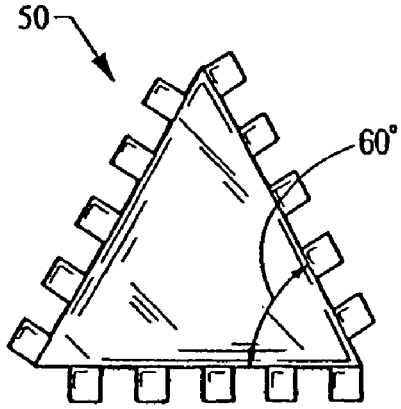
FIG. 8 is a top plan view of an equilateral triangular modular section which is another component of the apparatus of FIGS. 1-3.

The apparatus 20 for receiving and sorting recyclable materials according to the first illustrative embodiment is constructed using a plurality of interchangeable modular components, so that the apparatus can be adjustably adapted to different applications, depending on the needs of different users, or on the changing needs of a single user. Examples of some illustrative modular components include a square component 46, as shown in FIGS. 4A-4C, and a plurality of triangular components such as those shown at 48 and 50 in FIGS. 7-8.

Many of the interchangeable modular components are made with a hinge-like structure, and this structure will now be discussed in relation to the square component of FIGS. 4A-4C and 5-6. The hinge-like structure of each modular component, as illustrated by the square component 46, includes a plate portion 52 having a substantially straight peripheral edge 54, and a plurality of regularly spaced-apart cylindrical tube sections 56 attached to the peripheral edge of the plate portion. Each of the tube sections 56 has a longitudinal axis, such as that shown at 58 in FIG. 4A, which is disposed substantially parallel to the peripheral edge 54 to which it is attached.

Figure 5:
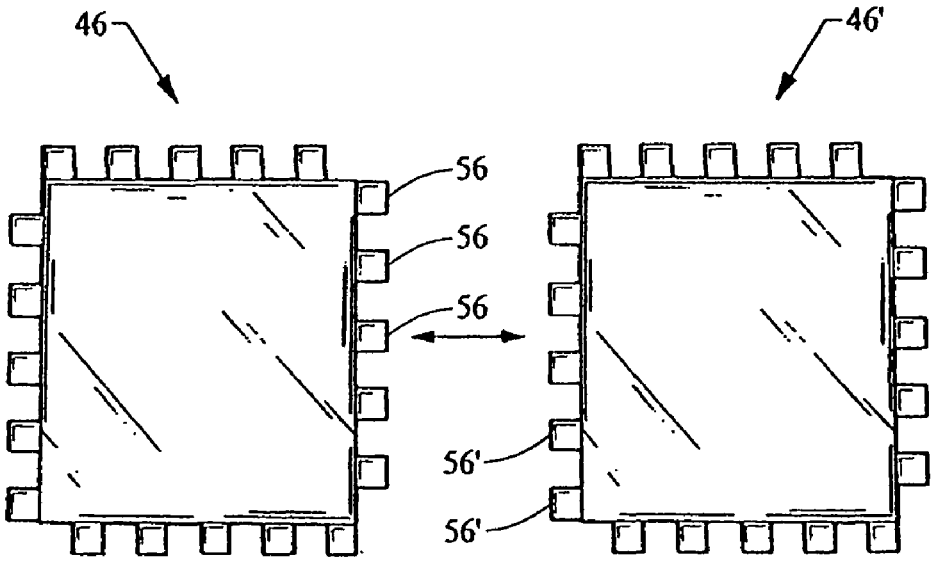
FIG. 5 is a top plan view of a pair of modular units of FIG. 4A placed side by side.
Figure 6:
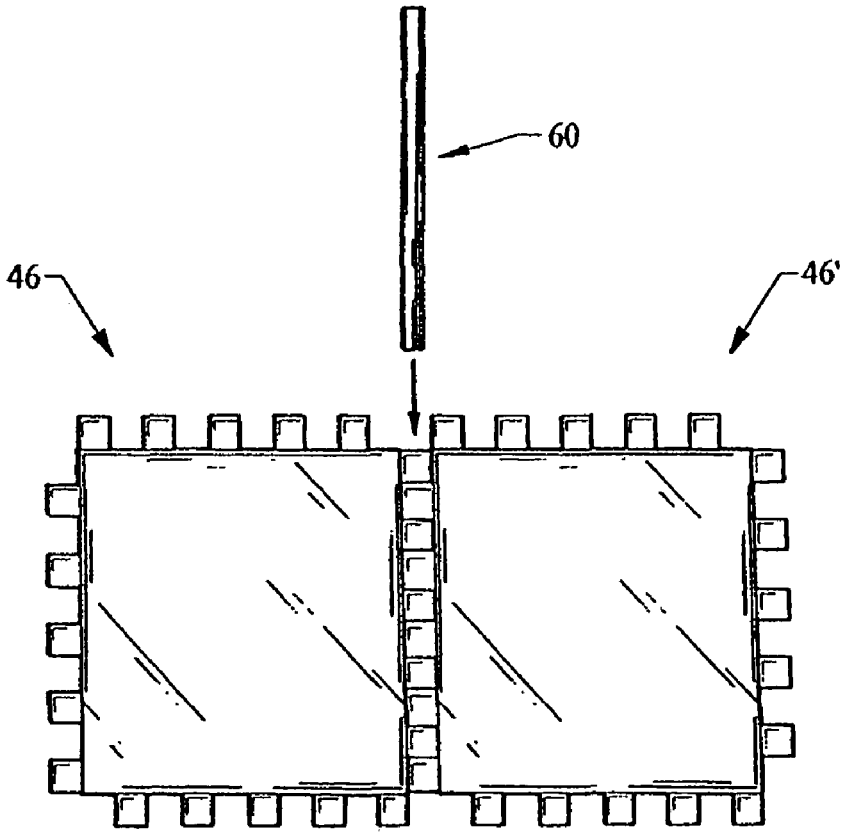
FIG. 6 is a top plan view of the modular units of FIG. 4B, moved into an aligned configuration, and also showing a connecting rod for joining the modular units together.

Referring now to FIGS. 5-6, it will be seen that the spaced-apart cylindrical tube sections 56 along a straight edge portion of the modular component 46 are adapted to cooperatively intermesh with another plurality of spaced-apart cylindrical tube sections 56' of another adjacent modular component 46', at which point the adjacent modular sections 46, 46' can be interconnected. This can be done repeatedly to create appropriate three-dimensional structures which, in turn, can be joined together to form the apparatus 20.

When the tube sections of adjacent modular components 46, 46' are intermeshed and aligned with one another, the adjacent components can be connected in one of two ways. The first way of connecting the intermeshed tube sections 46, 46' is to slidably place a rod 60 inside of the aligned tube sections, as shown in FIG. 6. A second, alternate way of connecting the intermeshed tube sections is to place an outer, external tube 62 (FIG. 4C) which has a longitudinal portion thereof removed, so that it has a C-shaped cross-section, over and partially covering a substantial exterior part of the aligned tube sections 56, 56'.

As previously noted, some selected components of the interchangeable modular components may include square or substantially rectangular plate portions. Other selected components of the interchangeable modular components may include substantially triangular plate portions.

Optionally, some or all of the plate portions 52 of the interchangeable modular sections may be formed from a translucent or transparent plastic material. If desired, the tube sections 56 may also be formed of plastic.

Figures 11, 12, 13:
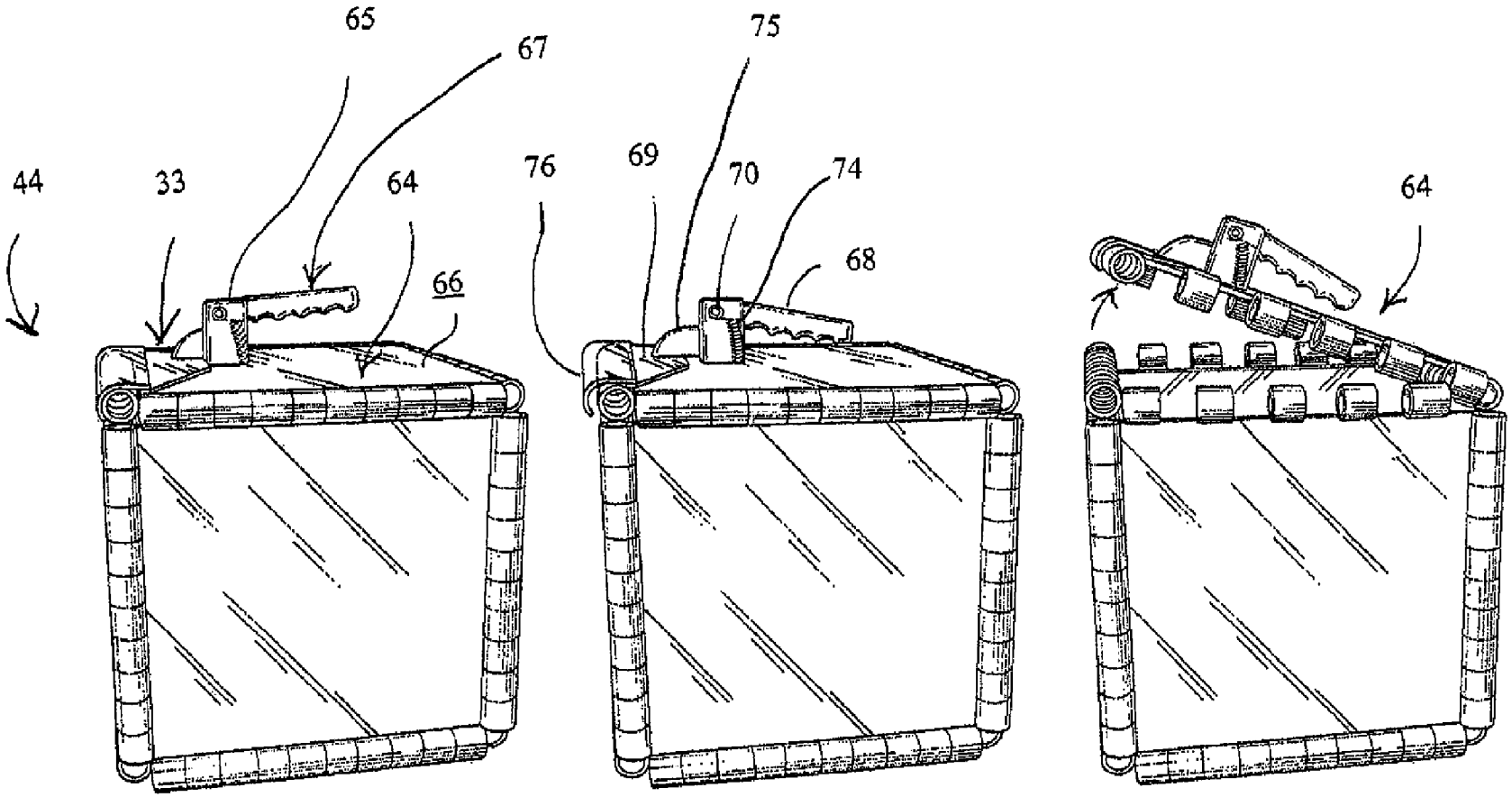
FIG. 11 is a perspective view of a storage container which is a component part of the apparatus of FIGS. 1-3, shown with a cover thereof in a closed position.
FIG. 12 is a second perspective view of the storage container of FIG. 11, with a handle depressed in order to release a latching assembly for the cover.
FIG. 13 is a third perspective view of the storage container of FIGS. 11-12, with the cover being pivotally lifted away from a main body of the container.
Figure 14:
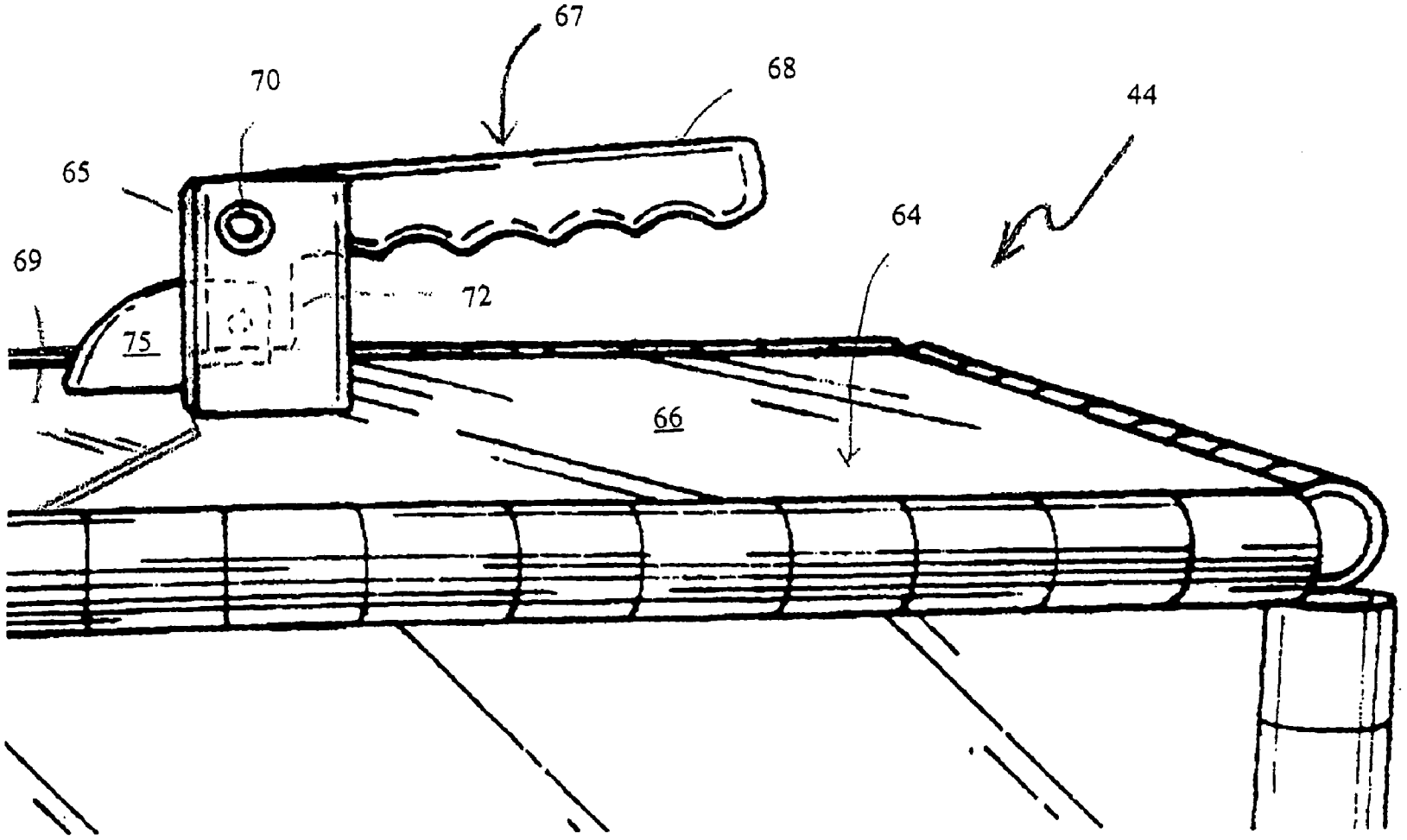
FIG. 14 is a detail view of the handle and latching mechanism of the storage container of FIGS. 11-13.

Referring now to FIGS. 11-13, a storage receptacle 44 is shown having a removable cover 64, where the cover includes a main plate 66, and a handle and latch mechanism 33 connected to the main plate. The handle and latch mechanism 33 on the cover 64 of the storage receptacle 44 shown in FIGS. 11-13 is substantially similar to the handle and latch mechanism used on the access doors 31 of the apparatus 20, and shown in FIG. 1.

The handle and latch mechanism 33 includes a hollow support member 65, which is provided as a three-sided rectangular box rigidly affixed on top of the main plate 66 of the cover 64. The support member 65 has a hollow cutout formed in the top thereof to provide clearance for the handle 67, and is also open on the side thereof facing away from the handle.

The handle 67 is pivotally attached to the support member 65 at a pivot connection 70, which may be provided as a rivet, or as a nut and bolt connection. The handle 67 is a generally L-shaped member, which includes a handgrip portion 68 extending outwardly away from the support member 65, and a connecting arm 72, integrally attached to the handgrip portion 68 and extending inwardly inside of the support member 65. A spring 74 is provided extending between the handle 67 and a movable plate 69 of the handle and latch mechanism 33. An innermost end of the connecting arm 72 is, in turn, pivotally attached to a linking member 75, and this linking member is affixed to the movable plate 69.

An arcuate locking lip 76 is integrally affixed to an outermost portion of the movable plate 69, and this locking lip extends around an edge of a plurality of tube sections 56 at an edge of a side panel of the container 44. The arcuate locking lip 76 is sufficiently rounded that when it is in abutting contact with the tube sections 56, the cover 64 is temporarily locked in a closed position over the top of the container 44, as illustrated in FIG. 11.

However, as illustrated in FIG. 12, when the handgrip portion 68 of the handle 67 is pressed inwardly, that pushes the linking member 75 outwardly and causes the movable plate 69 and the attached locking lip 76 to also move outwardly, away from the tube sections 56. This disengages the locking lip 76 from the side wall of the container 44, and permits the cover 64 to be pivotally lifted away from the main body of the container 44, thus opening the container.

An advantage of the above-described design for the handle and latch mechanism 33 is that when the gripping section 68 of the handle 67 is used to lift and carry the entire storage container 44, the upward lifting motion on the handle 67, coupled with the natural downward pull of gravity on the container, tends to pull the movable plate 69 and attached locking lip 76 inwardly, and to easily keep the cover 64 in locked engagement with the main body of the container 44.

Referring now to FIG. 10 of the drawings, a second illustrative embodiment of an apparatus for processing recyclable materials is shown generally at 120. The apparatus 120 according to the second embodiment is substantially similar to the apparatus 20 according to the first embodiment as previously described, except as specifically described as different herein.

In the embodiment of FIG. 10, the apparatus 120 includes an intake portion 122, part of which is adapted to extend through a building wall W (FIG. 3) and into an interior room of a building, such as a single family home, small business, or similar application. The apparatus 120 also includes a routing and storage portion 124 which is adapted to be disposed outside of the building.

In the embodiment of FIG. 10, the apparatus 120 for is usable for receiving, sorting and temporarily storing recyclable materials, such as glass (sorted by color), plastic of different grades, metal cans, etc. The apparatus 120 includes a hollow intake header box 125, having an inlet door (similar to that shown at 27 in FIG. 9B) and defining a temporary holding area therein, and a plurality of routing ducts 126-130, operatively attached to, and extending away from the intake header box 125. The routing ducts 126-130 may use passive gravity feed as a mechanism for moving an item therethrough. Each of the routing ducts 126-130 may have a door formed in a lower section thereof to provide access to a storage receptacle 44 (FIG. 3) disposed therein.

The apparatus 120 for receiving and sorting recyclable materials according to the second illustrative embodiment also includes a distribution mechanism 132 operatively connected to the header box 125. The distribution mechanism 132 may be disposed inside of the header box 125, or alternatively, the distribution mechanism 132 may be situated between the header box and the plurality of routing ducts 126-130. The distribution mechanism 132 may include mechanical and/or electromechanical components, and includes at least one movable routing gate. Optionally, the distribution mechanism 132 may include an optical scanner for reading a code on a recyclable item, to indicate the type of material in the header box 125.

Although the present invention has been described herein with respect to a number of specific embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. An apparatus for receiving and sorting recyclable materials, said apparatus comprising:

a hollow header box having an inlet door and defining a temporary holding area therein;

a distribution mechanism operatively connected to the header box;

a plurality of enclosed routing ducts attached to and extending outwardly from the distribution mechanism, wherein each of said routing ducts defines an exclusive pathway for receiving material from said temporary holding area;

a plurality of storage receptacles, with each of said storage receptacles disposed above ground and with a respective storage receptacle disposed proximate an end portion of each of said enclosed routing ducts, and a control panel comprising a plurality of selection buttons operatively connected to the header box for allowing a user to selectively indicate a material type corresponding to a recyclable item placed in the header box;

wherein each of said routing ducts of the apparatus comprises a plurality of interchangeable modular components, whereby the apparatus is configured to be adjustably adaptable to different applications;

and wherein the interchangeable modular components comprise a plurality of interconnectable sections, each of said interconnectable sections comprising at least one plate portion having a substantially straight peripheral edge and at least one hinge structure attached to said plate portion, wherein said hinge structure comprises a plurality of spaced-apart cylindrical tube sections attached to said peripheral edge.

2. The material sorting apparatus of claim 1, wherein each of said tube sections has a longitudinal axis disposed substantially parallel to the peripheral edge to which it is attached, and wherein said spaced-apart cylindrical tube sections are adapted to cooperatively intermesh with a plurality of spaced-apart cylindrical tube sections of another adjacent modular section.

3. The material sorting apparatus of claim 2, wherein selected ones of said interchangeable modular components, respectively, comprise a substantially rectangular plate portion.

4. The material sorting apparatus of claim 2, wherein selected elements of said interchangeable modular components respectively comprise a substantially triangular plate portion.

5. The material sorting apparatus of claim 2, wherein the plate portions of said interchangeable modular components are formed from a translucent or transparent plastic material.

6. The material sorting apparatus of claim 2, wherein the plate portions of said interchangeable modular components are formed from a metal.

7. The material sorting apparatus of claim 2, further comprising a mirror operatively attached to a rear wall of said header box.

8. The material sorting apparatus of claim 7, wherein the mirror comprises an edge portion which is pivotally attached to the header box in a manner configured to permit pivotal movement of the mirror relative to the header box.

9. The material sorting apparatus of claim 1, wherein the distribution mechanism comprises a first selectively operable routing gate situated proximate a first side wall of the header box, and a second selectively operable routing gate situated proximate a second side wall of the header box.

10. An apparatus for receiving and sorting recyclable materials, said apparatus comprising:

a hollow header box having an inlet door and a defining a temporary holding area therein;

a distribution mechanism operatively connected to the header box;

a plurality of enclosed routing ducts attached to and extending outwardly from the distribution mechanism, wherein each of said routing ducts defines an exclusive pathway for receiving material from said temporary holding area;

a plurality of storage receptacles, with each of said storage receptacles disposed above ground and with a respective storage receptacle disposed proximate an end portion of each of said enclosed routing ducts, and a control panel comprising a plurality of selection buttons operatively connected to the header box for allowing a user to selectively indicate a material type corresponding to a recyclable item placed in the header box;

wherein each of said routing ducts of the apparatus comprises a plurality of interchangeable modular components comprising a plurality of interconnectable sections, each of said interconnectable sections comprising at least one plate portion having a substantially straight peripheral edge and at least one hinge structure attached to said plate portion, wherein said hinge structure comprises a plurality of spaced-apart cylindrical tube sections attached to said peripheral edge, wherein each of said tube sections has a longitudinal axis disposed substantially parallel to the peripheral edge to which it is attached, and wherein said spaced-apart cylindrical tube sections are adapted to cooperatively intermesh with a plurality of spaced-apart cylindrical tube sections of another adjacent modular section.

11. The material sorting apparatus of claim 10, wherein selected elements of said interchangeable modular components respectively comprise a substantially triangular plate portion.

12. The material sorting apparatus of claim 10, wherein the plate portions of said interchangeable modular sections are formed from a translucent or transparent plastic material.

13. The material sorting apparatus of claim 10, further comprising a mirror operatively attached to a rear wall of said header box.

14. The material sorting apparatus of claim 10, wherein the plate portions of said interchangeable modular sections are formed from a metal.

15. The material sorting apparatus of claim 13, wherein the mirror comprises an edge portion which is pivotally attached to the header box in a manner configured to permit pivotal movement of the mirror relative to the header box.

16. The material sorting apparatus of claim 10, wherein selected ones of said interchangeable modular components, respectively, comprise a substantially rectangular plate portion.

17. The material sorting apparatus of claim 10, wherein the distribution mechanism comprises a first selectively operable routing gate situated proximate a first side wall of the header box, and a second selectively operable routing gate situated proximate a second side wall of the header box.

* * * * *